United States Patent [19]

Palazzola

[11] Patent Number: 4,856,675

[45] Date of Patent: Aug. 15, 1989

[54] WASTEBASKET BAG RETAINER

[76] Inventor: Sam Palazzola, 12365 Tiara, N. Hollywood, Calif. 91607

[21] Appl. No.: 101,791

[22] Filed: Sep. 28, 1987

[51] Int. Cl.[4] ..... B65D 90/00

[52] U.S. Cl. ..... 220/404; 220/1 T

[58] Field of Search ..... 220/404, 1 T, 94 R; 248/95, 101

[56] References Cited

U.S. PATENT DOCUMENTS

| | | | |
|---|---|---|---|
| 3,128,904 | 4/1964 | Reilly | 220/404 |
| 4,418,835 | 12/1983 | Watts | 220/1 T X |
| 4,535,911 | 8/1985 | Goulter | 220/1 T X |
| 4,558,800 | 12/1985 | Isgar et al. | 220/1 T X |
| 4,576,310 | 3/1986 | Isgar et al. | 220/404 |
| 4,589,570 | 5/1986 | Auten | 220/404 |
| 4,664,347 | 5/1987 | Brown et al. | 220/1 T X |
| 4,723,740 | 2/1988 | Courtemanche et al. | 248/95 |
| 4,735,340 | 4/1988 | Preston | 220/1 T X |

*Primary Examiner*—Steven M. Pollard

*Attorney, Agent, or Firm*—Blakely, Sokoloff, Taylor & Zafman

[57] ABSTRACT

A device for retaining and supporting a plastic shopping bag within a waste receptacle. A generally "F" shaped retainer is placed over the rim of a waste receptacle at each of two opposing sides thereof. Each retainer is held in place by a clip-like extension of the lower horizontal flange of the retainer that engages the rim of the receptacle and secures the retainer in place. Integral handles of the plastic shopping bag are placed over the upper horizontal member of each retainer and are retained within the channel defined by the upper and lower horizontal flanges of the "F" shaped retainers. The plastic shopping bag is thereby retained and supported in a open position within the waste receptacle.

3 Claims, 2 Drawing Sheets

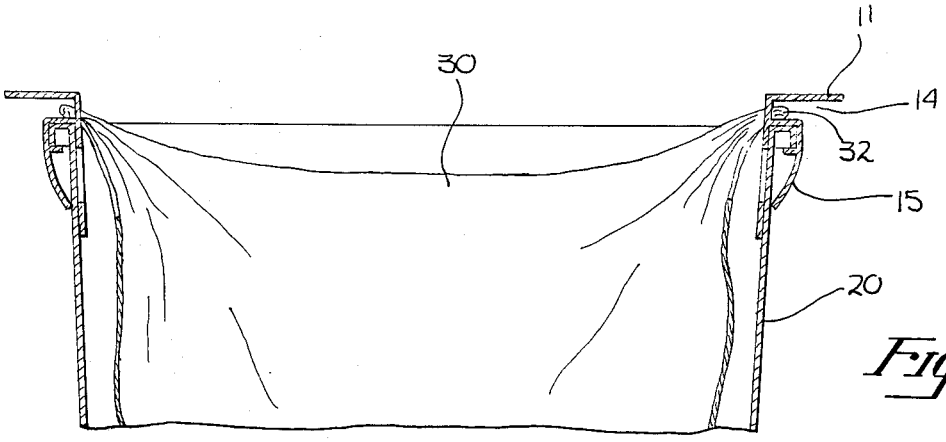
Fig. 4
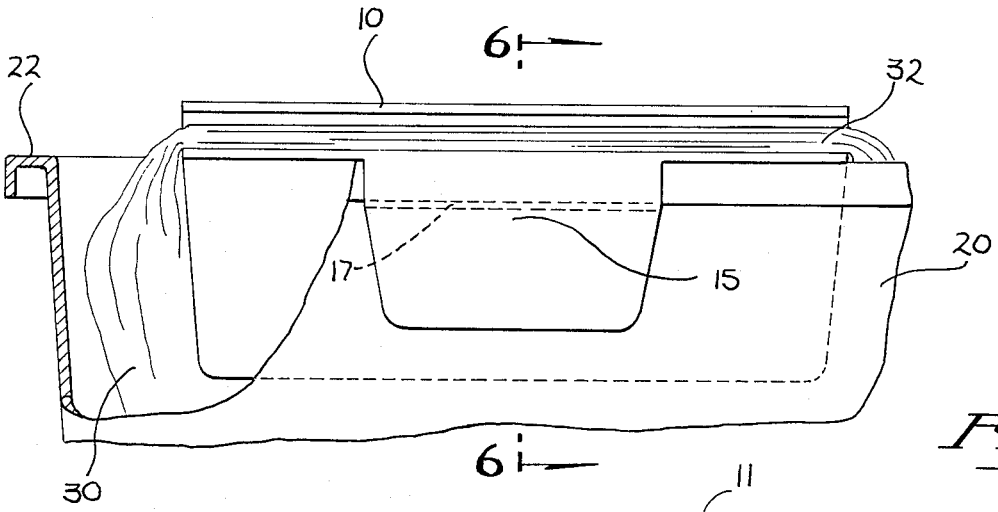
Fig. 5
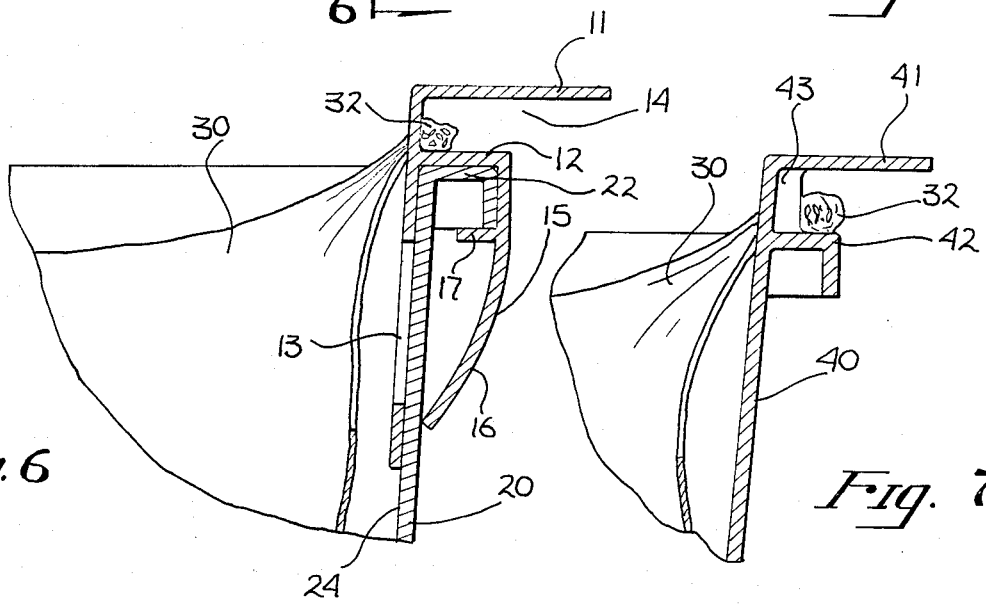
Fig. 6
Fig. 7

WASTEBASKET BAG RETAINER

FIELD OF THE INVENTION

This invention relates to a bag retainer device for wastebaskets, and more particularly, to a device for retaining common plastic carry bags in a household waste receptacle.

BACKGROUND ART

An unpleasant aspect of daily life is the accumulation of household trash. Such accumulation occurs throughout a typical house, but is known to be especially acute in the kitchen area. There is an almost limitless variety of waste receptacles known in the art. However, a problem common to nearly all receptacles is soiling of the interior of the receptacles due to the trash deposited therein. A common solution to this problem is the use of a bag or some form of liner in the receptacle for containing the trash and thereby preventing the trash from contacting the interior surfaces of the receptacle. One of the most widely used of such liners is the common brown paper shopping bag as used by many grocery stores.

A trend amongst many grocery stores and other retail outlets has been to replace the brown paper variety of bag with a bag made of a very thin gauge of plastic material. Such plastic bags frequently include integral handles and resemble a "tank top" style shirt which has been seamed at the waist. This variety of plastic bag is superior to the brown paper variety with regard to penetration resistance and ability to repel moisture. However, the plastic bags lack the "free standing" ability of brown paper bags and, therefore, are more difficult to employ as liners for household waste receptacles.

As will be subsequently described, the present invention provides a device suitable for use with most household trash receptacles whereby the common plastic bags as previously described may be conveniently supported within the receptacle for use as a liner.

SUMMARY OF THE INVENTION

A device for retaining and supporting a plastic shopping bag in a waste receptacle is disclosed. The device consists of a molded retainer having a cross-section resembling the letter "F". A clip-like extension of the lower horizontal flange fits over the rim of the receptacle and holds the retainer firmly in place thereon. Integral handles of the plastic bag are slipped over the retainers of the present invention and are retained in channels molded therein. The plastic bag is thus supported in an open position in which it may receive deposited waste.

BRIEF DESCRIPTION OF THE DRAWINGS

FIG. 4 is a cross section of the present invention taken along line 4—4 of FIG. 3.

FIG. 5 is a partially cut away elevation view of one of the retainers of the present invention.

FIG. 6 is a detailed cross sectional view of the present invention taken along line 6—6 of FIG. 5.

FIG. 7 is a partial sectional view of an alternative embodiment of the present invention.

DETAILED DESCRIPTION OF THE EMBODIMENTS

Figure 1:
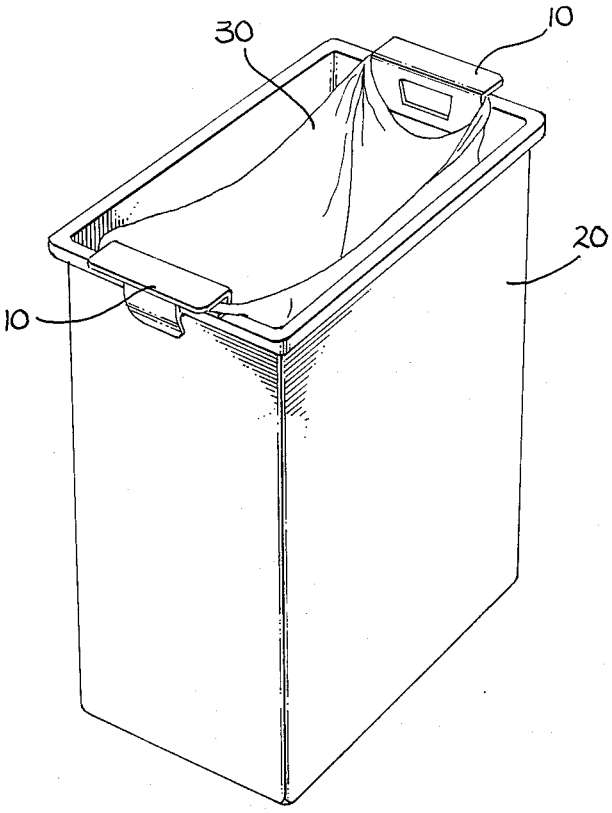
FIG. 1 is a perspective view showing the present invention in use with a typical waste receptacle.
Figure 2:
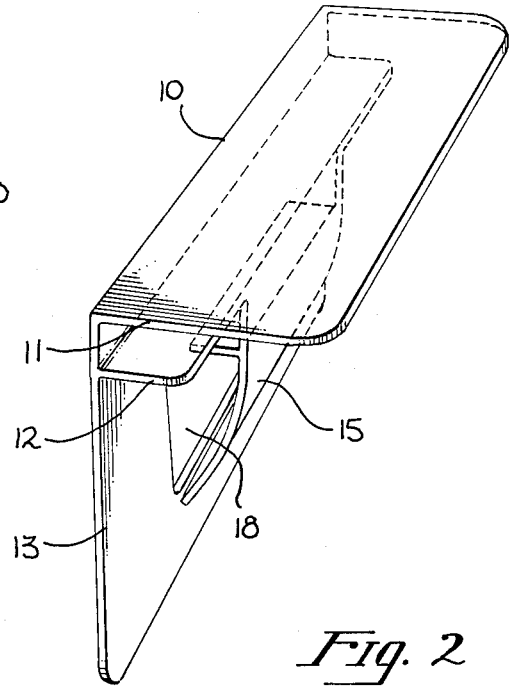
FIG. 2 is a detailed perspective view of the retainer of the present invention.

A retainer for retaining plastic shopping bags in a wastebasket is disclosed. In the following description, for purposes of explanation and not limitation, specific numbers, dimensions, materials, etc. are set forth in order to provide a thorough understanding of the present invention. However, it will be apparent to one skilled in the art that the present invention may be practiced without these specific details.

FIGS. 1–6 illustrate retainers 10 of the present invention in use with a typical waste receptacle 20 and a common plastic shopping bag 30. Receptacle 20 may be virtually any size, shape or material It is preferable, however, that receptacle 20 be of a generally square or rectangular shape so that it has two generally straight opposing sides and that it have a rim 22 surrounding the opening of the receptacle. Bag 30 is a plastic shopping bag of the type that is commonly provided to shoppers by grocery stores and other retail stores and that has integral handles 32.

Retainer 10 comprises horizontal flanges 11 and 12 and vertical flange 13. Flanges 11, 12 and 13 are joined such that retainer 10 has a cross-section resembling the letter "F". Clip 15 extends downwardly from lower horizontal flange 12 and comprises curving member 16 and horizontal member 17. The dimensions of clip 15 are selected such that horizontal member 17 fits underneath rim 22 of receptacle 20, thereby securing retainer 10 in place on receptacle 20.

Vertical flange 13 preferably includes aperture 18 of approximately the same size and shape as the projection of clip 15 to facilitate fabrication of retainer 10 as a single molding in a two-piece mold.

Figure 3:
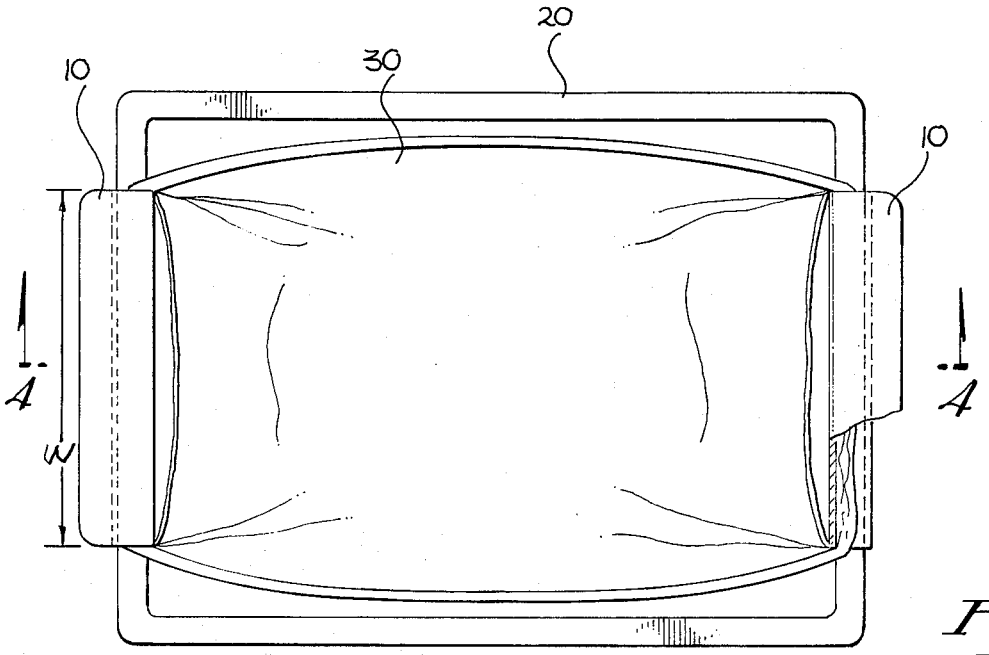
FIG. 3 is a plan view of the present invention in use with a typical waste receptacle.

Retainer 10 is preferably made of a plastic material, preferably by an injection molding process. Retainer 10 may also be made of a metal or other material and could be extruded rather than molded. Dimension W of retainer 10 as illustrated in FIG. 3 is preferably greater than approximately six inches so that bag 20 may be supported in a sufficiently open position to receive deposited waste.

In use, retainer 10 is positioned above the rim of receptacle 20 and aligned with an approximately straight portion thereof. Clip 15 is pried open using finger pressure to allow curving member 16 and horizontal member 17 to pass outside of rim 22 as vertical flange 13 is slid downwardly along inner surface 24. Pressure on clip 15 is released when horizontal flange 12 contacts rim 22, thereby allowing horizontal member 17 to be positioned beneath rim 22 and securing retainer 10 to receptacle 20 . . . Retainer 10 is thereby positioned with horizontal flanges 11 and 12 projecting outwardly from the opening of receptacle 20. To effectively retain bag 30, two retainers 10 are secured to receptacle 20, one on each of two opposing sides. After retainers 10 have been secured to receptacle 20, bag 30 is placed within receptacle 20 with handles 32 placed over flanges 11 and into channels 14 of retainers 10. Bag 30 is thereby retained and supported in an open position within receptacle 20.

In place of or in addition to clip 15, retainer 10 may be secured to receptacle 20 by means of adhesive strips (not shown). Such strips are commonly available having adhesive on both flat surfaces thereof and generally having a peeloff layer of paper or other protective material that may be removed when retainer 10 is applied to receptacle 20. One adhesive strip may be placed between horizontal flange 12 and rim 22. A second adhesive strip may be placed between vertical flange 13 and inner surface 24.

FIG. 7 illustrates an alternative embodiment of the present invention wherein a bag retainer 41 is integral with receptacle 40. This embodiment is functionally similar to that previously discussed except that retainer 41 is molded integrally with receptacle 40 rather than being a separate piece applied thereto. Thus, in this embodiment, the lower horizontal flange 12 of the previously described embodiment is functionally replaced by rim 42 of receptacle 40. Retainer 41 may include ribs 43 to provide additional stiffness, thereby preventing distortion of retainer 41 when bag 30 is heavily loaded.

It will be recognized that the above described invention may be embodied in other specific forms without departing from the spirit or essential characteristics of this disclosure. Thus, it is understood that the invention is not to be limited by the foregoing illustrative details except as set forth in the appended claims.

I claim:

1. A device for retaining and supporting a bag within a waste receptacle, the bag of the type having a pair of integral handles, said device comprising a retainer having a generally planar vertical flange and two generally planar horizontal flanges, said horizontal flanges each joined along an edge thereof to said vertical flange such that said retainer has a cross section generally in the shape of the letter "F", said retainer further having a clip extending downwardly from said horizontal flange, said clip including a horizontal member for engagement with an underside of a rim of a receptacle such that said retainer may be secured to said rim of said receptacle with said horizontal flanges extending in a direction away from an opening of the receptacle so that a handle of a bag placed inside the receptacle may be placed over an upper of said two horizontal flanges and retained between said upper and lower horizontal flanges, whereby a bag may be supported in an open position within a waste receptacle by a pair of said retainers disposed at opposing sides of the receptacle.

2. The device of claim 1 wherein said retainer is plastic.

3. The device of claim 1 wherein said retainer has a longitudinal dimension of at least approximately six inches.

* * * * *